US011086256B1

(12) United States Patent
Hamada

(10) Patent No.: US 11,086,256 B1
(45) Date of Patent: Aug. 10, 2021

(54) FIXING DEVICE AND IMAGE FORMING APPARATUS

(71) Applicant: KYOCERA Document Solutions Inc., Osaka (JP)

(72) Inventor: Toshiyuki Hamada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/162,066

(22) Filed: Jan. 29, 2021

(30) Foreign Application Priority Data

Jan. 31, 2020 (JP) ..... JP2020-014879

(51) Int. Cl.
*G03G 15/20* (2006.01)

(52) U.S. Cl.
CPC ..... *G03G 15/2028* (2013.01); *G03G 15/2064* (2013.01)

(58) Field of Classification Search
CPC ..... G03G 15/2028; G03G 15/2064
See application file for complete search history.

(56) References Cited

U.S. PATENT DOCUMENTS 7,486,922 B2 * 2/2009 Nakano ..... G03G 15/2028 271/311
2007/0280752 A1 * 12/2007 Uchida ..... G03G 15/2028 399/323
2017/0371284 A1 * 12/2017 Takagi ..... G03G 15/2028

FOREIGN PATENT DOCUMENTS

JP 2001166653 A * 6/2001
JP 2011-191450 9/2011

* cited by examiner

*Primary Examiner* — Sevan A Aydin
(74) *Attorney, Agent, or Firm* — Lex IP Meister, PLLC

(57) ABSTRACT

The fixing device includes a heated rotating body, a pressure rotating body, a heating unit configured to heat the heated rotating body, a separation claw, and a gap rolling member. The pressure rotating body is pressed against the heated rotating body to form a fixing nip portion. The separation claw separates the recording medium from the heated rotating body or the pressure rotating body. The gap rolling member is rotatably supported by the separation claw and abuts against an outer peripheral surface of the heated rotating body or the pressure rotating body to define a gap between the heated rotating body or the pressure rotating body and a tip portion of the separation claw. The separation claw has a conveyance surface facing the recording medium passing through the fixing nip portion, and a part of an outer peripheral surface of the gap rolling member protrudes from the conveyance surface.

10 Claims, 8 Drawing Sheets

FIXING DEVICE AND IMAGE FORMING APPARATUS

INCORPORATION BY REFERENCE

This application is based upon and claims the benefit of priority from Japanese Patent Application No. 2020-014879, filed on Jan. 31, 2020, the entire contents of which are incorporated herein by reference.

FIELD

The present disclosure relates to a fixing device used in an image forming apparatus such as a copier, a printer, a facsimile, or a multifunction peripheral thereof, and an image forming apparatus including the fixing device.

BACKGROUND

In order to fix a toner image on a sheet in an image forming apparatus, a fixing device including a fixing member in which a fixing roller or a fixing belt (heated rotating body) and a pressure roller (pressure rotating body) are in pressure contact with each other is widely used. In this fixing device, the sheet is passed through a fixing nip portion formed by the fixing roller and the pressure roller, and heat and pressure are applied to the toner image to melt and fix the toner image on the sheet.

In the fixing device as described above, the sheet may adhere to the fixing roller, the fixing belt, or the pressure roller (hereinafter referred to as the fixing roller or the like) due to the melted toner and may be wound around the fixing roller or the like. In view of this, a configuration has been proposed in which a separation claw is provided between the sheet having passed through the fixing nip portion and the fixing roller or the like, and the sheet is conveyed while being brought into sliding contact with the separation claw.

In the configuration in which the separation claw is brought into contact with the fixing roller or the like, the amount of wear of the roller surface in a portion with which the separation claw is brought into contact is larger than that in other portions. As a result, the roller surface (belt surface) becomes a rough surface, and there is a possibility that image quality deteriorates. Further, since the release layer is worn and the releasability of the sheet is lowered, there is a problem that the replacement cycle of the fixing roller or the like is shortened.

Therefore, a technique is known in which a rolling member is provided to form a gap between an edge of the separation claw and a surface of the fixing roller or the like. In this technique, since the rolling member is in contact with the fixing roller, there is a possibility that the offset toner on the fixing roller may adhere again to the surface of the rolling member. Then, when the toner is deposited on the surface of the rolling member for regulating the gap with time, the outer diameter of the rolling member increases and the gap at the edge of the separation claw widens, and there is a possibility that a constant gap cannot be maintained.

Therefore, there is disclosed a fixing device in which a cleaning mechanism for cleaning the toner accumulated on the surface of the rolling member for maintaining the gap between the tip of the separation claw and the roller is provided, thereby preventing the offset toner from being accumulated on the surface of the rolling member and the gap from being widened to deteriorate the separation performance.

SUMMARY

A first configuration of the present disclosure is a fixing device that includes a heated rotating body, a pressure rotating body, a heating unit, a separation claw, and a gap rolling member, and melts and fixes an unfixed toner image on a recording medium by heating and pressurizing the recording medium passing through a fixing nip portion. The pressure rotating body is pressed against the heated rotating body to form a fixing nip portion. The heating unit heats the heated rotating body. The separation claw is disposed in proximity to at least one of the heated rotating body and the pressure rotating body on a downstream side of the fixing nip portion with respect to an insertion direction of the recording medium, and separates the recording medium from the heated rotating body or the pressure rotating body. The gap rolling member is rotatably supported by the separation claw and abuts against an outer peripheral surface of the heated rotating body or the pressure rotating body to define a gap between the heated rotating body or the pressure rotating body and a tip portion of the separation claw. The separation claw has a conveyance surface facing the recording medium passing through the fixing nip portion, and a part of an outer peripheral surface of the gap rolling member protrudes from the conveyance surface.

Objects, features and advantages of the present disclosure will become more apparent from the following detailed description, in which reference is made to the accompanying drawings, in which preferred embodiments of the disclosure are shown by way of example.

DETAILED DESCRIPTION

Figure 1:
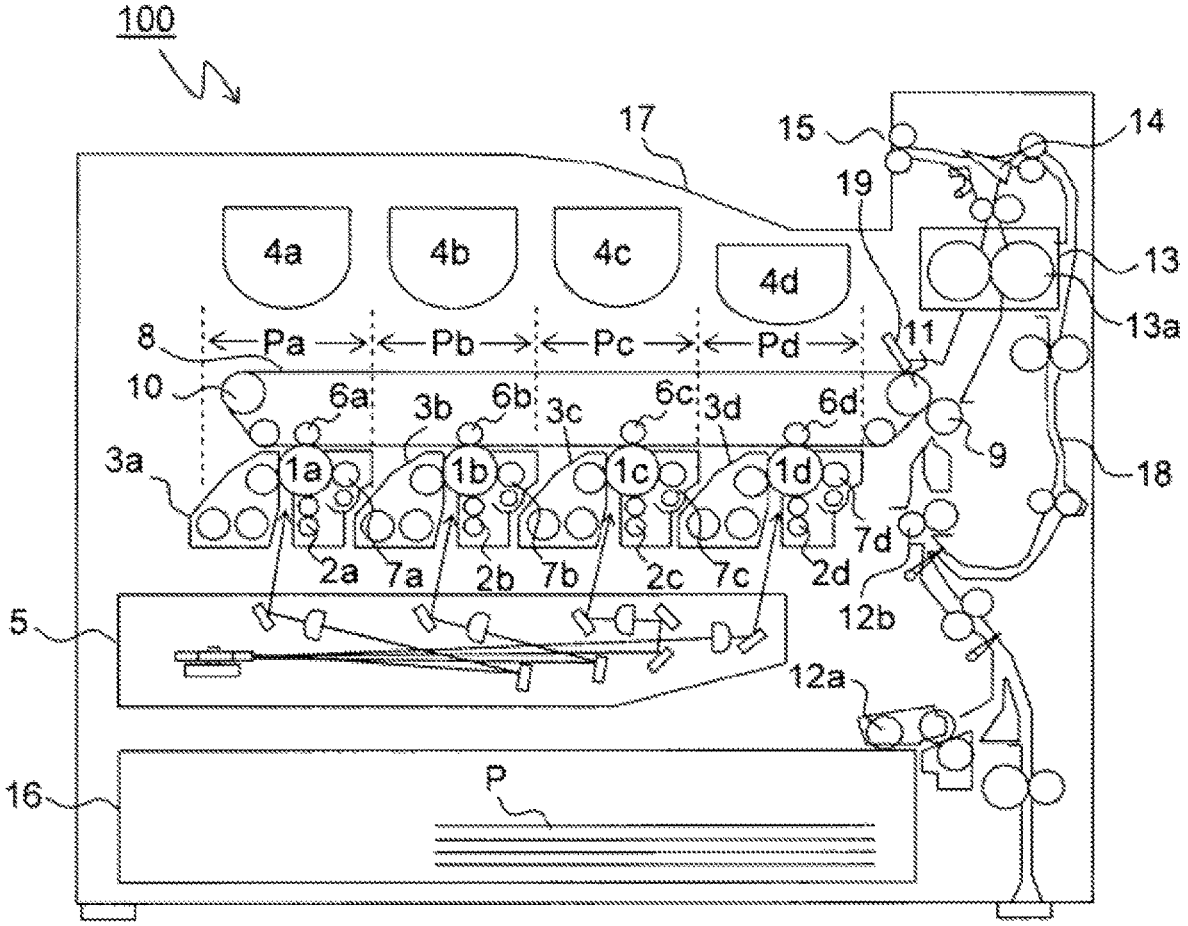
FIG. 1 is a schematic cross-sectional view showing an internal structure of an image forming apparatus 100 in which a fixing device 13 according to an embodiment of the present disclosure is mounted.

Hereinafter, embodiments of the present disclosure will be described with reference to the drawings. FIG. 1 is a schematic cross-sectional view showing an internal structure of an image forming apparatus 100 in which a fixing device 13 according to an embodiment of the present disclosure is mounted. Four image forming portions Pa, Pb, Pc, and Pd are disposed in the main body of the image forming apparatus 100 (here, a color printer) in this order from the upstream side in the conveyance direction (the left side in FIG. 1). These image forming portions Pa to Pd are provided so as to correspond to images of four different colors (cyan, magenta, yellow, and black), and sequentially form images of cyan, magenta, yellow, and black by respective steps of charging, exposure, development, and transfer.

Photosensitive drums (image carriers) 1*a*, 1*b*, 1*c*, and 1*d* that carry visible images (toner images) of respective colors are disposed in the image forming portions Pa to Pd, and an intermediate transfer belt 8 that rotates in a counterclockwise direction in FIG. 1 is disposed adjacent to the image forming portions Pa to Pd. The toner images formed on the photosensitive drums 1*a* to 1*d* are sequentially primarily transferred and superimposed on the intermediate transfer belt 8 moving while being in contact with the photosensitive drums 1*a* to 1*d*. Thereafter, the toner image primarily transferred onto the intermediate transfer belt 8 is secondarily transferred onto a sheet P as an example of a recording medium by a secondary transfer roller 9. Further, the sheet P onto which the toner image is secondarily transferred is discharged from the main body of the image forming apparatus 100 after the toner image is fixed in the fixing device 13. An image forming process for each of the photosensitive drums 1*a* to 1*d* is performed while the photosensitive drums 1*a* to 1*d* are rotated in the clockwise direction in FIG. 1 by a main motor (not shown).

The sheet P on which the toner image is secondarily transferred is accommodated in a sheet cassette 16 disposed in a lower portion of the main body of the image forming apparatus 100, and is conveyed to a nip portion between the secondary transfer roller 9 and the driving roller 11 of the intermediate transfer belt 8 via a sheet feeding roller 12*a* and a registration roller pair 12*b*. As the intermediate transfer belt 8, a sheet made of a dielectric resin is used, and a seamless belt is mainly used. A blade-shaped belt cleaner 19 for removing toner and the like remaining on the surface of the intermediate transfer belt 8 is disposed on the downstream side of the secondary transfer roller 9.

Next, the image forming portions Pa to Pd will be described. Around and below the rotatably disposed photosensitive drums 1*a* to 1*d*, charging devices 2*a*, 2*b*, 2*c*, and 2*d* for charging the photosensitive drums 1*a* to 1*d*, an exposure device 5 for exposing image information on the photosensitive drums 1*a* to 1*d*, developing devices 3*a*3*b*,3*c*, and 3*d* for forming toner images on the photosensitive drums 1*a* to 1*d*, and cleaning devices 7*a*, 7*b*, 7*c*, and 7*d* for removing developer (toner) and the like remaining on the photosensitive drums 1*a* to 1*d* and are provided.

When image data is input from a higher-level device such as a personal computer, first, the surfaces of the photosensitive drums 1*a* to 1*d* are uniformly charged by the charging devices 2*a* to 2*d*. Then, the surfaces of the photosensitive drums 1*a* to 1*d* are irradiated with light by the exposure device 5 according to the image data, and electrostatic latent images according to the image data are formed on the photosensitive drums 1*a* to 1*d*. Each of the developing devices 3*a* to 3*d* is filled with a predetermined amount of a two-component developer toner of each color of cyan, magenta, yellow, and black. When the ratio of the toner in the two-component developer filled in each of the developing devices 3*a* to 3*d* falls below a specified value due to formation of a toner image described later, the toner is supplied from the toner containers 4*a* to 4*d* to each of the developing devices 3*a* to 3*d*. The toner in the developer is supplied to the photosensitive drums 1*a* to 1*d* by the developing devices 3*a* to 3*d* and electrostatically adheres to the photosensitive drums 1*a* to 1*d*, so that toner images corresponding to electrostatic latent images formed by exposure from the exposure device 5 are formed.

Then, an electric field is applied between the primary transfer rollers 6*a* to 6*d* and the photosensitive drums 1*a* to 1*d* at a predetermined transfer voltage by the primary transfer rollers 6*a* to 6*d*, and the toner images of cyan, magenta, yellow, and black on the photosensitive drums 1*a* to 1*d* are primarily transferred onto the intermediate transfer belt 8. These four color images are formed in a predetermined positional relationship which is predetermined for forming a predetermined full color image. Thereafter, in preparation for subsequent formation of new electrostatic latent images, toner and the like remaining on the surfaces of the photosensitive drums 1*a* to 1*d* after the primary transfer are removed by the cleaning devices 7*a* to 7*d*.

The intermediate transfer belt 8 is stretched between an upstream driven roller 10 and a downstream driving roller 11. When the intermediate transfer belt 8 starts rotating in the counterclockwise direction in response to rotation of the driving roller 11 by the belt driving motor (not shown), sheet P is conveyed from the registration roller pair 12*b* to a nip portion (secondary transfer nip portion) between the driving roller 11 and the secondary transfer roller 9 provided adjacent thereto at a predetermined timing, and the full-color image on the intermediate transfer belt 8 is secondarily transferred onto the sheet P. The sheet P on which the toner image is secondarily transferred is conveyed to the fixing device 13.

The sheet P conveyed to the fixing device 13 is heated and pressed by the fixing roller 131 and the pressure roller 132 (see FIG. 2), and the toner image is fixed on the surface of the sheet P, so that a predetermined full-color image is formed. The conveyance direction of the sheet P on which the full-color image has been formed is distributed by the branch portion 14 that branches in a plurality of directions, and the sheet P is discharged to the discharge tray 17 by the discharge roller pair 15 as it is (or after the sheet P is sent to the duplex conveyance path 18 and images are formed on both sides).

Figure 2:
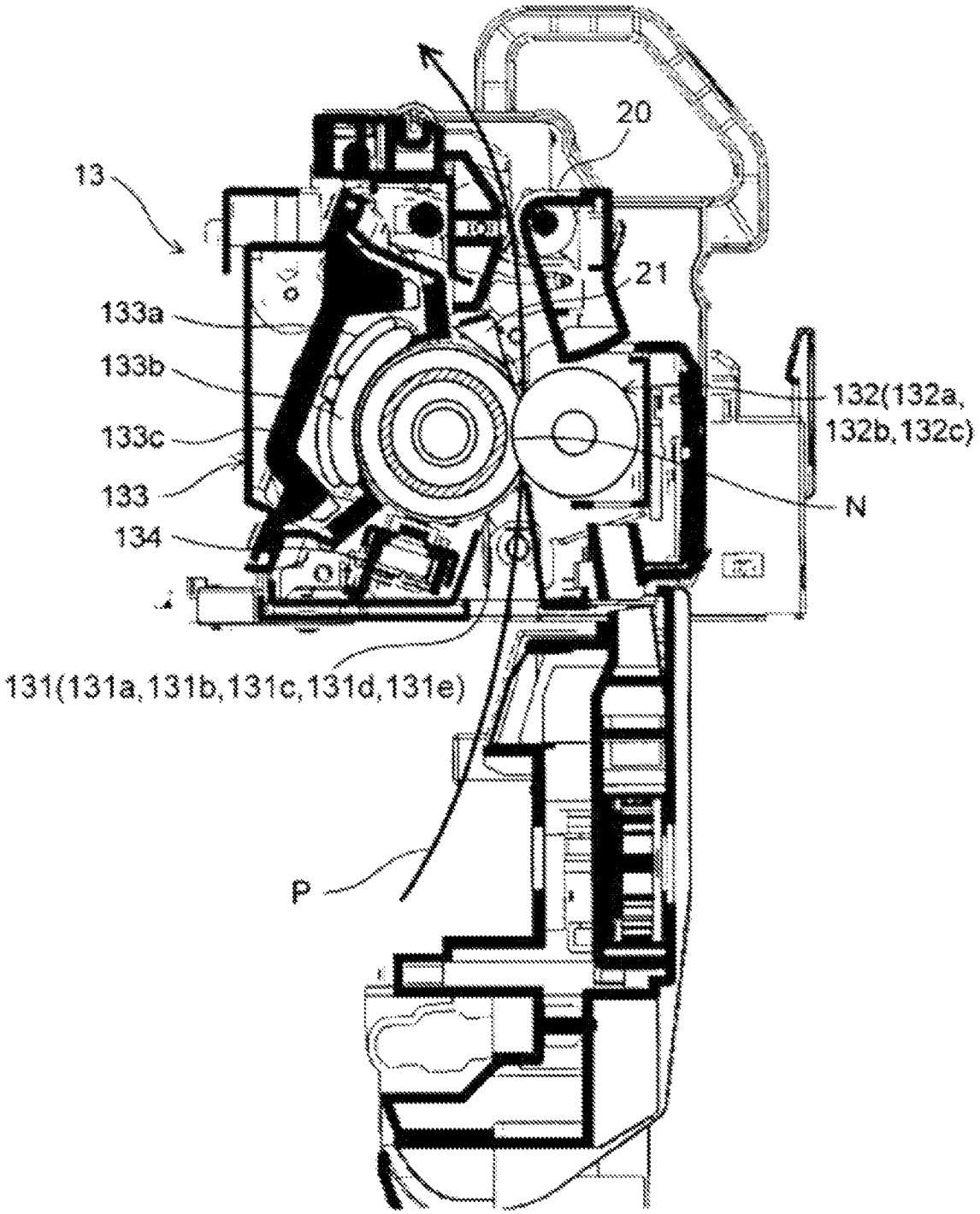
FIG. 2 is a side cross-sectional view of the vicinity of a fixing device 13 in FIG. 1.

FIG. 2 is a side cross-sectional view of the periphery of the fixing device 13 in FIG. 1.

The fixing device 13 is of a fixing type using a heat source of an electromagnetic induction heating type, and includes a fixing roller 131 as a heating unit, a pressure roller 132 as a pressure rotating body, an induction heating unit 133 disposed to face an outer periphery of the fixing roller 131, and a temperature sensor 134 including a thermistor or the like for detecting a temperature of a surface of the fixing roller 131. The induction heating unit 133 and the temperature sensor 134 are fixed to the main body of the image forming apparatus 100, and the fixing roller 131 and the pressure roller 132 are rotatably held by the housing of the fixing device 12.

The fixing roller 131 includes a base material 131*a* made of cylindrical stainless steel, an elastic layer 131*d* made of silicone rubber sponge for imparting elasticity to the fixing nip portion N pressed against the pressure roller 132, and a release layer 131*e* made of fluororesin for imparting releasability to the elastic layer 131*d*, and further includes a heat insulating layer 131*b* and an induction heating layer 131*c* between the base material 131*a* and the elastic layer 131*d* in this order from the base material side.

The pressure roller 132 includes a base material 132*a* made of a core metal made of aluminum, an elastic layer 132*b* made of silicon rubber formed on the base material 132*a* in order to impart elasticity to the fixing nip portion N, and a release layer 132*c* made of a fluororesin tube covering the surface of the elastic layer 132*b* in order to improve releasability when an unfixed toner image is melted and fixed in the fixing nip portion N.

The pressure roller 132 is rotationally driven by a drive source (not shown) such as a motor, and is further pressed toward the center in the radial direction of the fixing roller 131. As a result, the pressure roller 132 comes into pressure contact with the fixing roller 131, and when the pressure roller 132 rotates, the fixing roller 131 is driven to rotate in the same direction in the fixing nip portion N.

The temperature sensors 134 are disposed so as to face a sheet passing region at a center portion in the axial direction (width direction) of the fixing roller 131 and both end portions in the axial direction which become non-sheet passing regions when a sheet of a small size such as a A4 vertical size is passed, and detect temperatures of the respective regions. Based on the temperature detected by temperature sensor 134, power supplied to induction heating unit 133 is controlled, and the surface of fixing roller 131 is maintained at a predetermined temperature.

The induction heating unit 133 includes an excitation coil 133*a*, a bobbin 133*b*, and a core 133*c*, and heats the fixing roller 131 by electromagnetic induction. The induction heating unit 133 extends in the axial direction of the fixing roller 131 and is disposed to face the fixing roller 131 so as to surround a part of the outer periphery of the fixing roller 131.

The excitation coil 133*a* made of copper wires is wound around the bobbin 133*b* and spirally disposed over a part of the outer periphery of the fixing roller 131 so as to circulate in the axial direction around the central portion of the core 133*c*. The excitation coil 133*a* is connected to a high-voltage power supply (not shown) and generates magnetic fluxes by a high-frequency current supplied from the power supply. The magnetic fluxes emitted from the induction heating unit 133 are emitted in a direction parallel to the paper surface of FIG. 2 and penetrates through the induction heating layer 131*c* of the fixing roller 131. Eddy currents are generated around the magnetic fluxes in the induction heating layer 131*c* and when the eddy currents flow, Joule heat is generated by electric resistance in the induction heating layer 131*c* and the induction heating layer 131*c* generates heat.

The power of the high voltage power supply is controlled based on the temperature detected by the temperature sensor 134 so that the fixing roller 131 is heated to a predetermined temperature by the induction heating unit 133. When the fixing roller 131 is heated to a predetermined temperature, the sheet P nipped by the fixing nip portion N is heated and pressed by the pressure roller 132, whereby the toner in a powder state on the sheet P is melted and fixed.

The sheet P on which the toner has been fixed is discharged to the discharge tray 17 from the discharge roller pair 15 via the fixing conveyance roller pair 20 (see FIG. 1). The linear velocity of the fixing conveyance roller pair 20 is set slightly higher than the linear velocity of the fixing roller 131 and the pressure roller 132 so that the conveyed sheet P is not bent. A separation claw 21 is disposed on the downstream side of the fixing nip portion N in the sheet conveyance direction.

Figure 3:
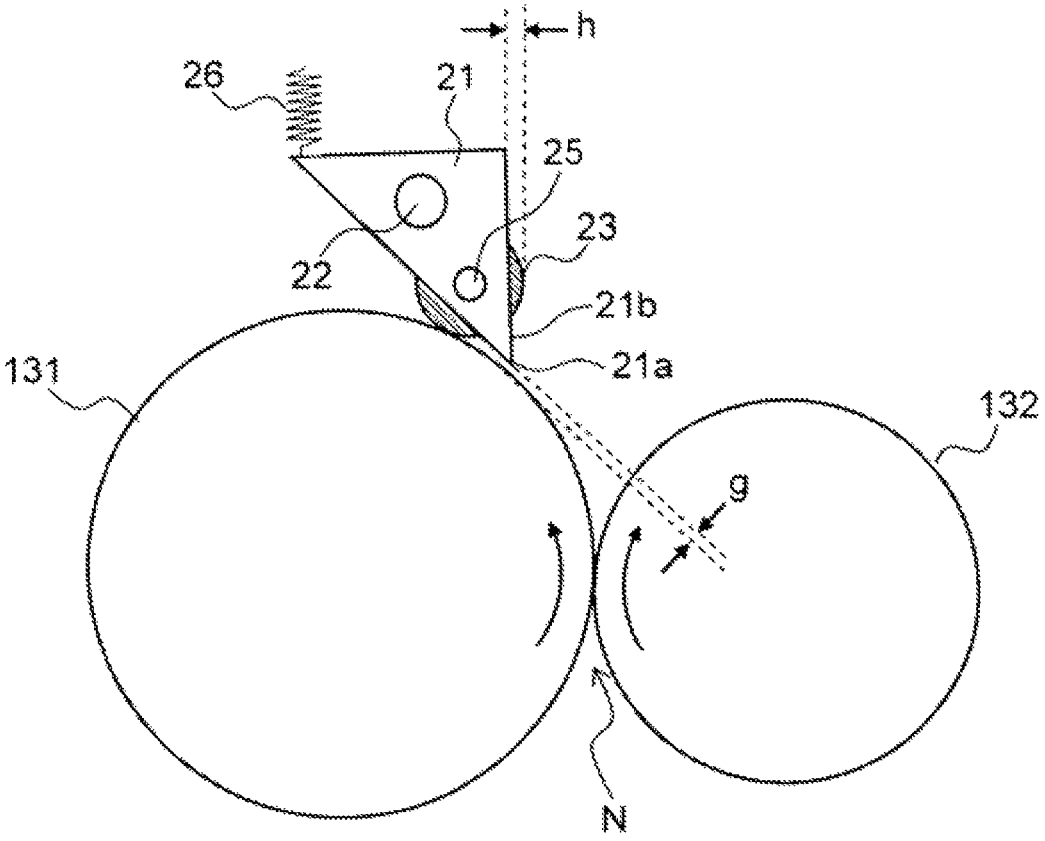
FIG. 3 is a partially enlarged view of the vicinity of fixing roller 131 and pressure roller 132 of fixing device 13 in FIG. 2.
Figure 4:
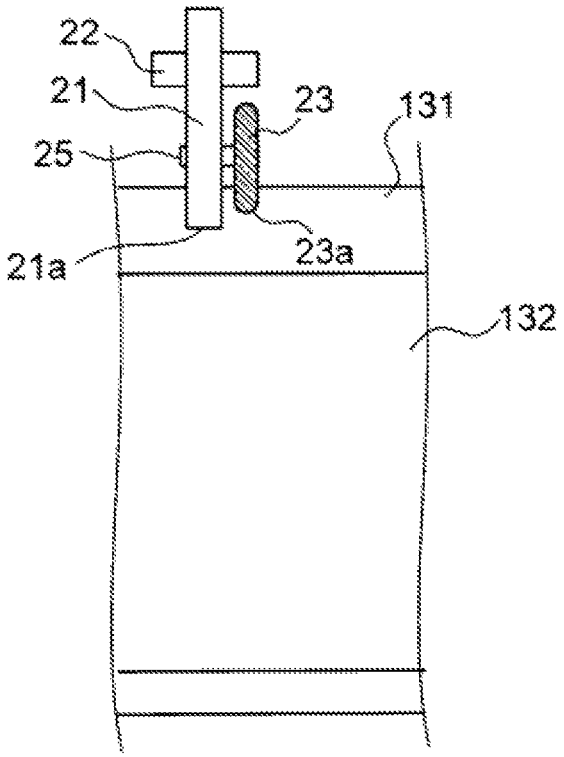
FIG. 4 is a view of a separation claw 21 seen from a direction (right direction in FIG. 3) perpendicular to the sheet insertion direction.

FIG. 3 is a partially enlarged view of the vicinity of the fixing roller 131 and the pressure roller 132 of the fixing device 13 shown in FIG. 2. FIG. 4 is a view of the separation claw 21 viewed from a direction perpendicular to the sheet insertion direction (right direction in FIG. 3). The separation claws 21 are arranged at equal intervals at a plurality of positions along the axial direction of the fixing roller 131 (the left-right direction in FIG. 4), and one of the plurality of separation claws 21 is illustrated in FIG. 4.

The separation claw 21 separates the sheet P having passed through the fixing nip portion N from the surface of the fixing roller 131. The separation claw 21 has a triangular shape in side view, and is supported so as to be swingable about a support shaft 22 parallel to the rotation axis of the fixing roller 131.

The separation claw 21 is provided with a gap rolling member 23 that defines a clearance (gap) between the distal end portion 21*a* of the separation claw 21 and the outer peripheral surface of the fixing roller 131. The gap rolling member 23 is rotatably supported by a rotation shaft 25 parallel to the support shaft 22. The rotation shaft 25 is provided on the upstream side of the support shaft 22 with respect to the rotation direction (counterclockwise direction) of the fixing roller 131. The gap rolling member 23 is formed of a resin material, and the surface thereof is coated with a fluorine-based resin to which toner hardly adheres.

A tension spring 26 is connected to an end portion of the separation claw 21 on the downstream side (the side opposite to the gap rolling member 23) with respect to the rotation direction of the fixing roller 131. The tension spring 26 urges the distal end portion 21*a* of the separation claw 21 toward the fixing roller 131, by urging the end portion on the side opposite to the gap rolling member 23 across the support shaft 22 upward, thereby urging the gap portion of the separation claw 21 toward the fixing roller 131. This prevents the gap rolling member 23 from separating from the outer peripheral surface of the fixing roller 131. Instead of providing the tension spring 26, the distal end portion 21*a* side of the separation claw 21 may be urged downward by the own weight of the separation claw 21.

With the above-described configuration, the separation claw 21 is disposed at a predetermined angle such that the distal end portion 21*a* of the separation claw 21 faces the upstream side with respect to the rotation direction of the fixing roller 131 (in the counter direction) and the distal end portion 21*a* of the separation claw 21 is close to the outer peripheral surface of the fixing roller 131 with the gap g therebetween. In order to prevent the sheet P from entering between the fixing roller 131 and the separation claw 21, the gap is set to 0.1 mm or less.

Further, as shown in FIG. 4, the contact surface (outer peripheral surface) 23*a* of the gap rolling member 23 with respect to the fixing roller 131 has an arc-shaped cross section (axial cross section) when cut along the extending direction (right-left direction in FIG. 4) of the rotation shaft 25. As a result, the contact area between the gap rolling member 23 and the fixing roller 131 is decreased, and the adhesion of the toner to the gap rolling member 23 is reduced. As a result, the distal end portion 21*a* of the separation claw 21 is lifted by the adhering toner, and it is possible to suppress the occurrence of a paper jam caused by the sheet P entering between the fixing roller 131 and the separation claw 21.

The separation claw 21 has a conveyance surface 21*b* facing the sheet P having passed through the fixing nip portion N. A part of the outer peripheral surface of the gap rolling member 23 protrudes from the conveyance surface 21*b* of the separation claw 21.

Figure 5:
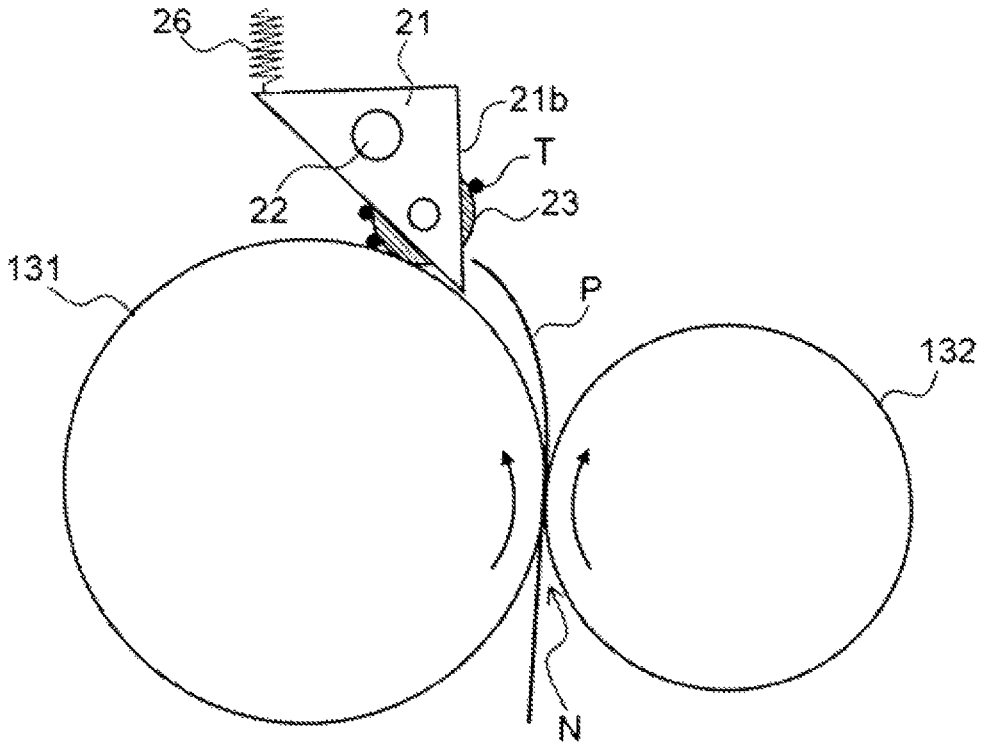
FIG. 5 is a side sectional view showing a state in which a sheet P is inserted through a fixing nip portion N in a fixing device 13 of the present embodiment, and showing a state in which a sheet P is conveyed while being curved in a direction approaching a conveyance surface 21*b* of a separation claw 21.
Figure 6:
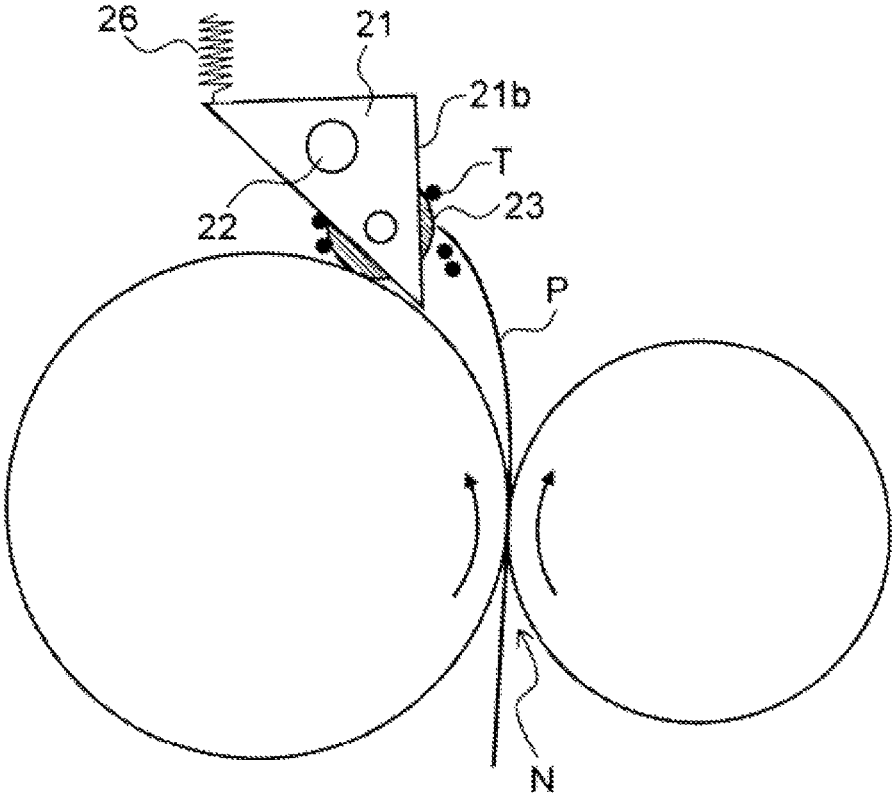
FIG. 6 is a view showing a state in which a sheet P is further conveyed from the state shown in FIG. 5 and a leading edge of a sheet P is in contact with a gap rolling member 23 protruding from the conveyance surface 21*b*.

FIGS. 5 and 6 are side sectional views showing a state in which the sheet P is inserted through the fixing nip portion N in the fixing device 13 of the present embodiment. By repeatedly inserting the sheet P on which the toner image is formed, a part of the toner on the sheet P is transferred (offset) to the outer peripheral surface of the fixing roller 131. As shown in FIG. 5, the toner T adhering to the outer peripheral surface of the fixing roller 131 adheres again to the outer peripheral surface of the gap rolling member 23.

On the other hand, the sheet P having passed through the fixing nip portion N is separated from the fixing roller 131, at the image region where the toner image having a large adhesion force with the fixing roller 131 is formed after the margin portion at the leading end. Therefore, the sheet P is conveyed while being curved in a direction (indicated by a solid line in FIG. 5) approaching the conveyance surface 21*b* of the separation claw 21.

When the sheet P is further conveyed from the state shown in FIG. 5, as shown in FIG. 6, the leading edge of the sheet P slides on the outer peripheral surface of the gap rolling member 23 protruding from the conveyance surface 21*b* of the separation claw 21, and thus moves toward the downstream side in the conveying direction (upward in FIG. 6). On the other hand, the gap rolling member 23 is driven by the fixing roller 131 to rotate in the clockwise direction in FIG. 6.

That is, the leading end of the sheet P comes into contact with the outer peripheral surface of the gap rolling member 23 from the moving direction (from the upper side to the lower side) of the outer peripheral surface of the gap rolling member 23 and the counter direction (from the lower side to the upper side). As a result, the toner T adhering to the outer peripheral surface of the gap rolling member 23 is scraped off by the leading edge of the sheet P, to fall on the outer peripheral surface of the fixing roller 131.

The toner T having fallen on the outer peripheral surface of the fixing roller 131 may adhere again to the surface of the fixing roller 131 at the fixing nip portion N in some cases. However, since the toner T will then be dispersed in the axial direction of the fixing roller 131 to fall off, the possibility of the toner T adhering again to the outer peripheral surface of the gap rolling member 23 is low. If the toner T does adhere again to the outer peripheral surface of the gap rolling member 23, the toner T will then be scraped off by the leading edge of the sheet P again. Therefore, there is no possibility of the toner T being deposited on the outer peripheral surface of the gap rolling member 23.

If the protrusion height h of the gap rolling member 23 from the conveyance surface 21*b* is too large, the leading edge of the sheet P may collide with the boundary between the conveyance surface 21*b* and the gap rolling member 23, and a jam may occur. The protrusion height h of the gap rolling member 23 is preferably equal to or less than 1 mm, and more preferably equal to or less than 0.5 mm.

According to the configuration of the present embodiment, by providing the gap rolling member 23 that defines the clearance (gap) between the distal end portion 21*a* of the separation claw 21 and the outer peripheral surface of the fixing roller 131, the sharp distal end portion 21*a* does not come into contact with the outer peripheral surface of the fixing roller 131. Therefore, abrasion and wear of the release layer 131*e* on the fixing roller 131 can be reduced.

Further, since a part of the outer peripheral surface of the gap rolling member 23 protrudes from the conveyance surface 21*b* of the separation claw 21, the toner attached to the gap rolling member 23 can be removed by the leading end of the sheet P inserted into the fixing nip portion N. Thus, it is possible to suppress floating of the separation claw 21 due to accumulation of the toner on the outer peripheral surface of the gap rolling member 23 and occurrence of jam due to separation failure of the sheet P caused by the floating.

Figure 7:
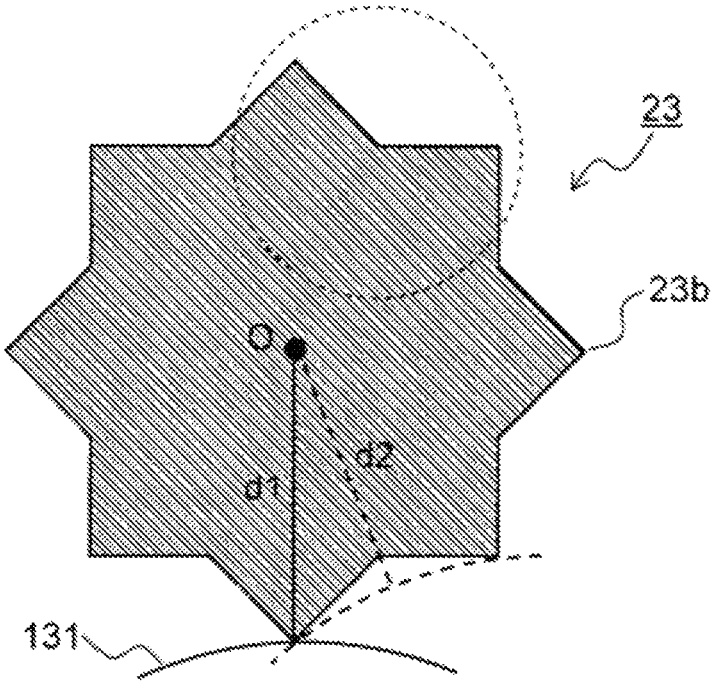
FIG. 7 is a plan view showing a modification of a gap rolling member 23 used in a fixing device 13.

FIG. 7 is a plan view showing a modification of a gap rolling member 23 used in a fixing device 13. The gap rolling member 23 is not limited to a circular shape, and may have a shape of a gear having many protrusions 23*b* on the peripheral edge portion as illustrated in FIG. 7. The gap rolling member 23 having a shape of a gear may further reduce the area of contact with the fixing roller 131. As a result, the toner adhesion to the outer peripheral surface of the gap rolling member 23 can be effectively restrained.

Further, when the gear-shaped gap rolling member 23 is rotated in contact with the outer peripheral surface of the fixing roller 131, the distance d1 from the rotation center O to the outer peripheral surface of the fixing roller 131 in contact with the protrusion 23*b* at one end point is longer than the distance d2 from the rotation center O to the outer peripheral surface of the fixing roller 131 in contact with the protrusion 23*b* at two adjacent end points.

Therefore, when the gap rolling member 23 rotates, a clearance (gap) between the distal end portion 21*a* of the separation claw 21 and the outer peripheral surface of the fixing roller 131 also cyclically changes, so that the distal end portion 21*a* of the separation claw 21 oscillates rhythmically. According to this, the toner adhering to the distal end portion 21*a* of the separation claw 21 can be scooped out. During this process, if the difference between the distances d1 and d2 is set to 0.1 mm or less, the amount of change of the clearance (gap) between the distal end portion 21*a* of the separation claw 21 and the outer peripheral surface of the fixing roller 131 will not exceed 0.1 mm, thereby to prevent the sheet P from entering between the fixing roller 131 and the separation claw 21.

Figure 8:
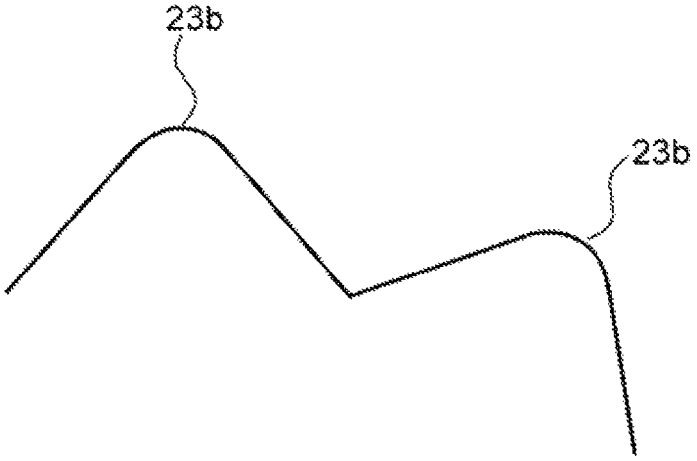
FIG. 8 is a partially enlarged view of a protrusion 23*b* of a gap rolling member 23 shown in FIG. 7.

FIG. 8 is a partially enlarged view of a protrusion 23*b* (within a broken line circle) of the gap rolling member 23 shown in FIG. 7. When the gap rolling member 23 is formed in a gear shape as shown in FIG. 7, it is preferable that a tip of the protrusion 23*b* is formed in an arc shape (R shape) in a side view as shown in FIG. 8. Thereby, it is possible to suppress scraping and abrasion of the release layer 131*e* of the fixing roller 131 by the protrusion 23*b*.

Figure 9:
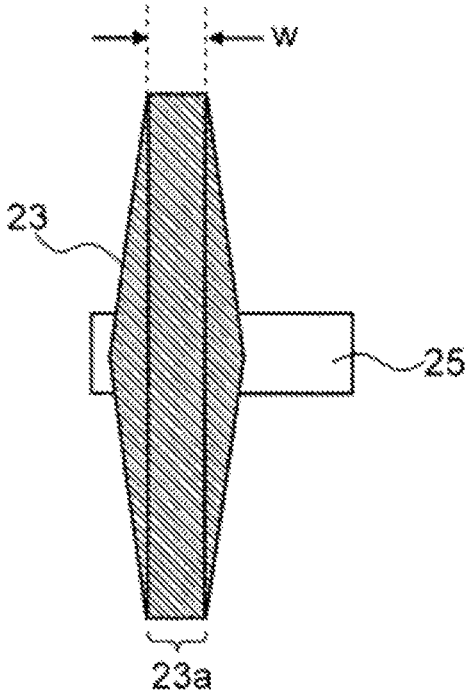
FIG. 9 is a front view of another modified example of a gap rolling member 23 used in a fixing device 13 as viewed from a direction orthogonal to a rotation shaft 25.

FIG. 9 is a front view of another modified example of the gap rolling member 23 used in the fixing device 13 viewed from a direction orthogonal to the rotation shaft 25. The contact surface 23*a* of the gap rolling member 23 with respect to the fixing roller 131 is not limited to a circular arc shape as shown in FIG. 4, but may be a flat shape as shown in FIG. 9.

When the contact surface 23*a* has a flat shape, the width w of the contact surface 23*a* in the axial direction is preferably equal to or less than the 1 mm. As a result, the contact area of the gap rolling member 23 with respect to the fixing roller 131 can be reduced to suppress toner adhesion.

In addition, the present disclosure is not limited to the above-described embodiment, and various modifications can be made without departing from the spirit of the present disclosure. For example, in the above described above, the separation claw 21 and the gap rolling member 23 are provided on the fixing roller 131 side. However, in a case where winding of the sheet P around the pressure roller 132 occurs during double-sided printing, a configuration in which the separation claw 21 and the gap rolling member 23 are provided on the pressure roller 132 side is also possible.

The separation claw 21 and the gap rolling member 23 may be provided on both of the fixing roller 131 side and the pressure roller 132 side.

In addition, in the above-described embodiment, the roller heating type fixing device 13 including the fixing roller 131 as the heated rotating body is exemplified, but it is needless to say that the present invention can be applied to a fixing device including a heated rotating body other than the fixing roller 131, such as a belt heating type fixing device including an endless fixing belt. The heating method is not limited to the induction heating method using the induction heating unit 133 including the excitation coil and the core. For example, a halogen heater may be used as the heating unit.

Further, in the fixing device 13 of the vertical conveyance type in which the sheet P passes through the fixing nip portion N from the lower side to the upper side as shown in the above embodiment, since the direction of the gravity applied to the sheet P is different from the peeling direction, the action of the gravity cannot be expected when the sheet P is peeled from the fixing roller 131 or the pressure roller 132. Therefore, it is particularly effective to assist the separation by the separation claw 21 and the gap rolling member 23. However, the present disclosure is also applicable to a fixing device of a horizontal conveyance type in which the sheet P horizontally passes through the fixing nip portion N.

The image forming apparatus 100 is not limited to a tandem color printer as illustrated in FIG. 1, and can be applied to various image forming apparatuses including a fixing device, such as a monochrome copier, a digital multifunction peripheral, a facsimile, and a laser printer.

The present disclosure is applicable to a fixing device configured to melt and fix a toner image on a recording medium by inserting the recording medium into a fixing nip portion formed by a heated rotating body and a pressure rotating body and applying heat and pressure to the toner image. According to the present disclosure, it is possible to provide a fixing device capable of reliably separating a recording medium from a rotating body and maintaining a gap between a tip of a separation claw and the rotating body without using a cleaning mechanism, and an image forming apparatus including the fixing device.

Note that the description of the above embodiment shows one aspect of the image forming apparatus according to the present disclosure, and the technical scope of the present disclosure is not limited to the above embodiment. The present disclosure may be variously changed, replaced, and modified without departing from the spirit of the technical idea, and the claims include all embodiments that can be included in the scope of the technical idea.

What is claimed is:

1. A fixing device comprising:

a heated rotating body;

a pressure rotating body that is pressed against the heated rotating body to form a fixing nip portion;

a heating unit configured to heat the heated rotating body;

a separation claw disposed on a downstream side of the fixing nip portion with respect to an insertion direction of the recording medium and in proximity to at least one of the heated rotating body and the pressure rotating body, the separation claw separating the recording medium from the heated rotating body or the pressure rotating body; and a gap rolling member rotatably supported by the separation claw and configured to contact an outer peripheral surface of the heated rotating body or the pressure rotating body to define a gap between the heated rotating body or the pressure rotating body and a distal end portion of the separation claw, wherein the fixing device melts and fixes an unfixed toner image on the recording medium by heating and pressurizing the recording medium passing through the fixing nip portion, the separation claw has a conveyance surface facing the recording medium passing through the fixing nip portion, and a part of an outer peripheral surface of the gap rolling member protrudes from the conveyance surface.

2. The fixing device according to claim 1, wherein a protrusion height of the gap rolling member from the conveyance surface is equal to or less than 1 mm.

3. The fixing device according to claim 2, wherein a protruding height of the rolling member from the conveyance surface is equal to or less than 0.5 mm.

4. The fixing device according to claim 1, wherein the gap rolling member has a gear shape in which a large number of protrusions are formed on a peripheral edge portion, and tips of the protrusions have an arc shape in a side view.

5. The fixing device according to claim 1, wherein a contact surface of the gap rolling member with respect to the heated rotating body or the pressure rotating body in an axial direction has an arc shape.

6. The fixing device according to claim 1, wherein a contact surface of the gap rolling member with respect to the heated rotating body or the pressure rotating body in an axial direction has a flat shape, and a width of the contact surface in the axial direction is equal to or less than 1 mm.

7. The fixing device according to claim 1, wherein the separation claw is supported so as to be swingable about a support shaft parallel to a rotation axis of the heated rotating body, and the gap rolling member is rotatably supported between the support shaft and the distal end portion of the separation claw.

8. The fixing device according to claim 1, comprising: a biasing member configured to bias the distal end portion of the separation claw in a direction in which the distal end portion of the separation claw approaches the heated rotating body or the pressure rotating body.

9. The fixing device according to claim 1, being a vertical conveyance type in which the insertion direction is from a lower side to an upper side of the fixing nip portion.

10. An image forming apparatus comprising the fixing device according to claim 1.

* * * * *